United States Patent [19]

Willis et al.

[11] 4,407,373

[45] Oct. 4, 1983

[54] COLLAPSIBLE PEDESTAL FOR DRILLING APPARATUS

[75] Inventors: Clyde A. Willis; Jerry K. Lingafelter, both of Wichita Falls, Tex.

[73] Assignee: Walker-Neer Mfg. Co., Inc., Wichita Falls, Tex.

[21] Appl. No.: 269,278

[22] Filed: Jun. 1, 1981

[51] Int. Cl.[3] ..... B23Q 5/00

[52] U.S. Cl. ..... 173/141; 173/171; 187/67; 267/139

[58] Field of Search ..... 173/46, 141, 147, 151, 173/171; 175/12; 187/67; 267/137, 139; 299/12

[56] References Cited

U.S. PATENT DOCUMENTS

| | | | |
|---|---|---|---|
| 747,357 | 12/1903 | Baker | 187/67 |
| 1,581,458 | 4/1926 | Lindquist | 187/67 X |
| 1,932,060 | 10/1933 | Arnold | 187/67 |
| 3,437,367 | 4/1969 | Blank | 267/139 X |
| 4,020,909 | 5/1977 | Airaudo | 173/147 |

*Primary Examiner*—James G. Smith

*Assistant Examiner*—Robert P. Olszewski

*Attorney, Agent, or Firm*—Hume, Clement, Brinks, Willian & Olds, Ltd.

[57] ABSTRACT

A drilling apparatus of the type including a platform, a pair of spaced, parallel, substantially vertical guide rails, and a power swivel which is guided along the guide rails is provided with a pair of space support surfaces positioned on the underside of the swivel. In addition, a pair of collapsible pedestals are mounted on the platform, each pedestal positioned under a respective support surface such that the swivel rests on the pedestals when lowered toward the platform. These pedestals are provided with a collapse strength chosen such that the pedestals collapse in a controlled, progressive manner, substantially without damage to the guide rails, in the event the swivel falls from at least a predetermined height. In this way both the platform and any drill string attached to the swivel are protected from excessive loads associated with abrupt deceleration of the swivel, and the incidence of string breakage due to such abrupt deceleration is at least substantially reduced.

7 Claims, 4 Drawing Figures

10
12
14
16
18
20
22
24
26
28
30
32
34
50
52
54
56
58
60
4.

COLLAPSIBLE PEDESTAL FOR DRILLING APPARATUS

BACKGROUND OF THE INVENTION

The present invention relates to an improvement in drilling apparatus to substantially reduce the incidence of drill string breakage occasioned by abrupt deceleration of the drill string following a failure in the drill string support apparatus.

One prior art type of drilling apparatus utilizes a power swivel which is guided along spaced, parallel, substantially vertical guide rails, such that the power swivel is movable vertically. The power swivel includes means for supporting a string of down-hole tubulars such as drill pipe, and the drilling apparatus includes means for raising and lowering the power swivel so as to control the position of the string.

One important problem previously encountered with such drilling apparatus relates to damage to the string caused by a failure of the swivel positioning means. For example, in the event the cables or other structures used to support, raise and lower the swivel fail, the swivel and the attached string can drop vertically. Typically, if the swivel is dropped it decelerates abruptly when it strikes the platform on which the guide rails are mounted. Such abrupt deceleration can result in breakage of the string in the borehole, which represents a severe setback to drilling operations. In addition, a falling swivel can severely damage the platform and the guide rails of the drilling apparatus.

SUMMARY OF THE INVENTION

The present invention is directed to an improvement in such drilling apparatus, which substantially reduces the incidence of string breakage due to abrupt deceleration of the type described above.

According to this invention, a drilling apparatus of the type including a platform, means for supporting a string of down-hole tubulars, means for guiding the vertical movement of the support means, and means for raising and lowering the support means in the guide means is provided with at least one and preferably a pair of collapsible pedestals mounted on the platform. Each of these pedestals is positioned under a respective support surface defined by the underside of the support means, such that the support means rests on the collapsible pedestals when lowered toward the platform. The collapsible pedestals are designed such that the collapse strength of the pedestals is within a selected range, such that the pedestals collapse in a controlled, progressive manner, substantially without damage to the guide means, in the event the support means falls from at least a predetermined height. In this way, both the platform and the string are protected from excessive loads associated with abrupt deceleration of the support means, and the incidence of string breakage due to such abrupt deceleration is at least substantially reduced.

Thus, the present invention provides a collapsible, energy absorbing pedestal which acts to retard a falling support means such as a swivel in a controlled and progressive manner. In this way the maximum deceleration of the swivel, and therefore the maximum deceleration of the string, are substantially reduced, thereby reducing the maximum loads exerted on the platform and the string by such decelerations.

The invention itself, together with further objects and attendant advantages, will best be understood by reference to the following detailed description taken in connection with the accompanying drawings.

DETAILED DESCRIPTION OF THE PRESENTLY PREFERRED EMBODIMENT

Figures 1, 2, 3, 4:
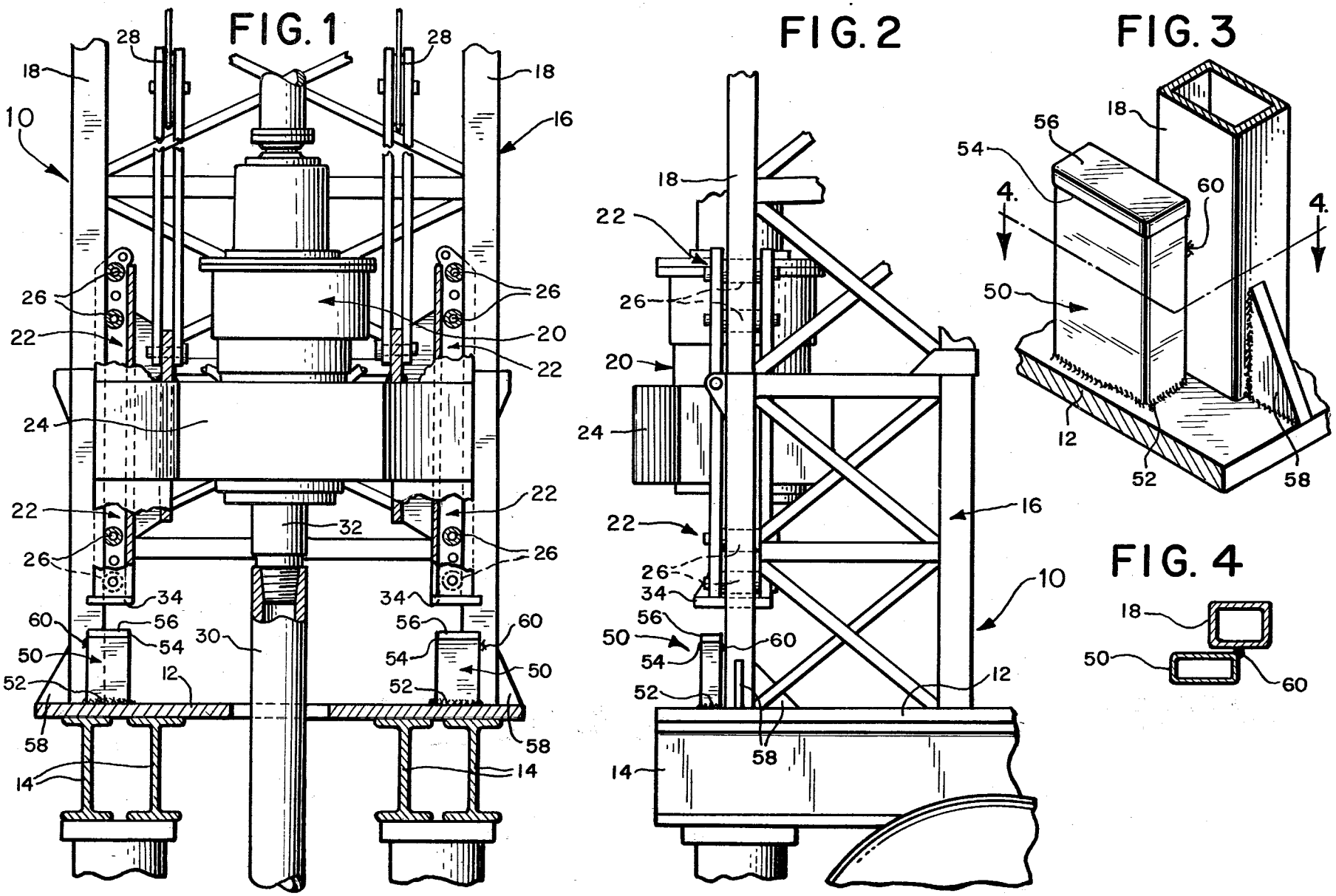
FIG. 1 is a rear elevational view in partial cutaway of a portion of a drilling apparatus which incorporates a presently preferred embodiment of this invention.
FIG. 2 is a side elevational view of the drilling apparatus of FIG. 1.
FIG. 3 is a perspective view of a portion of the drilling apparatus of FIG. 1, showing one of the collapsible pedestals in detail.
FIG. 4 is a partial sectional view taken along line 4—4 of FIG. 3.

Turning now to the drawings, FIG. 1 is a rear elevational view of a portion of a drilling apparatus which incorporates a presently preferred embodiment of this invention. In FIG. 1, the reference numeral 10 is used to designate generally the drilling apparatus. This drilling apparatus 10 includes a substantially horizontally oriented platform 12 which is supported on four substantially horizontal, parallel I-beams 14. As best shown in FIG. 2, the platform of this preferred embodiment is mounted on a wheeled, mobile trailer; however, it should be understood that the present invention can readily be adapted for use with other types of platforms, including platforms which are not trailer mounted.

The platform 12 serves to mount a mast 16 which extends substantially vertically above the platform 12. This mast 16 is heavily braced and includes two spaced, parallel, substantially vertical guide rails 18. These guide rails serve to guide the vertical movement of a power swivel 20 which is provided with guide means 22 which cooperate with the guide rails 18 to restrict the power swivel 20 to substantially vertical movement. The guide means 22 includes a plurality of guide rollers 26 mounted to roll along respective portions of the guide rails 18. The power swivel 20 also includes a transverse support bar 24 which extends between the two guide means 22. This support bar 24 serves to mount a pair of spaced sheaves 28 which are used in connection with wire cables and a winch (not shown) to control the vertical position of the power swivel 20 in the mast 16. The power swivel 20 of this embodiment is substantially identical to the power swivel described in detail in co-pending U.S. Pat. Application Ser. No. 158,452, filed June 11, 1980, assigned to the assignee of the present invention. This application is hereby incorporated herein by reference for its detailed description of the power swivel 20.

The power swivel 20 operates to support and rotate a string of down-hole tubulars 30 such as a drill string. As shown in FIG. 1 the string 30 is coupled to the power swivel 20 by means of a swivel sub 32. The lowermost end of each of the guide means 22 defines a substantially planar, horizontally oriented support surface 34.

Also included in the drilling apparatus 10 of this invention are two collapsible pedestals 50. Each of these pedestals defines a lower end 52 which is securely attached to the platform 12, as for example by welding, and an upper end 54. Each pedestal 50 includes a respective upper plate 56 which is securely affixed to the respective upper end 54 of the respective collapsible pedestal 50, as for example by welding. Each of these collapsible pedestals 50 is mounted adjacent the lower end of one of the guide rails 18 in direct alignment with the respective support surface 34, such that when the swivel 20 is lowered to its lowermost position, each of the support surfaces 34 comes into direct contact with the substantially planar, horizontal upper plate 56 of the respective pedestal 50 such that the pedestals 50 bear the weight of the power swivel 20. Also included in this embodiment are a pair of gussets 58 which serve to strengthen and brace the lowermost end of each of the guide rails 18. As best shown in FIG. 3, the pedestals 50 are not welded or otherwise attached to the guide rails 18 except for a single spot weld 60. This spot weld 60 should be dimensioned to break under excessive loads such that the pedestals 50 are completely free to move with respect to the guide rails 18 once the spot weld 60 has been broken.

As best shown in FIG. 4, each of the pedestals 50 is formed of a tubular steel section. In this preferred embodiment, each of the pedestals is about 12 inches in length and is formed of a rectangular steel member having a wall thickness of about $\frac{1}{4}$ of an inch and outside dimensions of about 2 inches by 6 inches. Preferably, the tubular members are formed of type TT-70 steel. Each upper plate 56 of this preferred embodiment is a steel plate measuring approximately 2 inches by 6 inches, having a thickness of about $\frac{3}{8}$ of an inch, and formed of type A-36 steel.

Pedestals formed of the materials described above have a collapse strength of about 280,000 pounds. Such pedestals have been found suitable for use in connection with drilling apparatus of the type having a maximum string load of about 160,000 pounds. Such drilling apparatus is typically used in conjunction with a dry string load of about 90,000–100,000 pounds in drilling boreholes up to a maximum depth of about 4,000–6,000 feet.

Because the pedesals 50 are positioned directly under the support surfaces 34 of the power swivel 20, the pedestals 50 can be used to support the power swivel 20 when it is lowered for transport of the drilling apparatus 10. Thus, it is preferable that the collapse strength of the pedestals 50 be great enough to support the static weight of the unloaded swivel 20.

The collapsible pedestals 50 provide important protection to the drilling apparatus 10 and to the string 30 in the event of a failure in the means for supporting the power swivel 20. If the winch (not shown), cables or sheaves 28 supporting the power swivel 20 should fail while the swivel 20 is loaded with the string 30, the power swivel 20 and the attached string 30 will fall. In this event, the guide means 20 serves to insure that the support surfaces 34 of the power swivel 20 contact the collapsible pedestals 50. The impact of the power swivel 20 on the pedestals 50 breaks the spot welds 60 attaching the collapsible pedestals 50 to the guide rails 18 and the pedestals 50 collapse in a controlled, progressive manner by forming a series of corrugations or accordion-type folds in the pedestal walls. As the pedestals 50 collapse, the power swivel 20 and the attached sring 30 are decelerated in a gradual, controlled manner so as to reduce by a significant amount the maximum deceleration, and therefore the maximum load, applied to the platform 12, the swivel 20, and the string 30. In this way, the incidence of string breakage is substantially reduced. Furthermore, the gussets 58 serve to strengthen the lower ends of the guide rails 18 and thereby to reduce damage to the guide rails 18 occasioned by such a failure of the support means for the power swivel 20.

From the foregoing, it should be apparent that an improved, collapsible pedestal has been described which substantially prevents the damage normally associated with a free-falling swivel crashing into a support platform. These collapsible pedestals operate to contact the swivel before it reaches the underlying platform and to decelerate the swivel in a controlled, progressive, and relatively gradual manner so as significantly to reduce the maximum deceleration loads applied to the string and thereby to protect the string against breakage in such situations.

Of course, it should be understood that various changes and modifications to the preferred embodiment described above will be apparent to those skilled in the art. For example, the collapsible pedestals of this invention can be used in connection with mobile or stationary platforms, and other collapsible structures in addition to the hollow tubular pedestal illustrated above may be adapted for use with this invention. Furthermore, in other embodiments it may be preferable to increase or decrease the total number of pedestals, depending on the requirements of the application. It is therefore intended that the foregoing detailed description be taken as illustrative of the presently preferred embodiment rather than as defining the scope of this invention, and that it be understood that it is the following claims, including all equivalents, which define the scope of this invention.

We claim:

1. In a drilling apparatus comprising a platform, means for supporting a string of down-hole tubulars, means for guiding the vertical movement of the string support means, and means for raising and lowering the string support means in the guide means, the improvement comprising:

at least two support surfaces, each positioned laterally with respect to the string and defined by one of the string support means and the platform; and at least two collapsible pedestals mounted on the other of the string support means and the platform, each pedestal positioned in alignment with a respective support surface such that the support surfaces come into contact with the pedestals when the string support means is lowered toward the platform, said pedestals having a collapse strength chosen such that the pedestals rigidly support the string support means at a first level above the platform when static, and, in the event the string support means and the string fall from at least a predetermined height, collapse in a controlled, progressive manner, substantially without damage to the guide means, thereby protecting both the platform and the string from excessive loads associated with abrupt deceleration of the string support means and at least substantially reducing the incidence of string breakage due to such abrupt deceleration of the string support means.

2. The invention of claim 1 wherein each of the support surfaces is planar and horizontally oriented and each of the collapsible pedestals defines a respective planar, substantially horizontal contact surface, each contact surface positioned in direct alignment with the respective support surface.

3. The invention of claim 1 wherein each of the support surfaces is positioned on the underside of the string support means, and wherein each of the pedestals comprises:

a tubular member having a lower end positioned on the platform and an upper end; and a planar, substantially horizontal plate mounted to the upper end of the tubular member in alignment with the respective support surface.

4. The invention of claim 1 wherein the guide means comprises a pair of spaced, parallel, substantially vertically oriented guide rails, each of the collapsible pedestals is positioned adjacent a respective one of the guide rails and each of the pedestals is spot welded to the respective guide rail.

5. The invention of claim 4 wherein the string support means comprises a power swivel.

6. In a drilling apparatus comprising a platform, a pair of spaced, parallel guide rails, a power swivel including means for supporting a string of down-hole tubulars, means for guiding the swivel for movement along the guide rails, and means for raising and lowering the swivel along the guide rails, the improvement comprising:

a pair of spaced support surfaces positioned on the underside of the swivel, each support surface positioned adjacent a respective one of the two guide rails; and a pair of collapsible, tubular pedestals mounted on the platform, each pedestal defining a respective upper surface and each pedestal positioned adjacent a respective one of the two guide rails in alignment with the respective one of the two support surfaces such that, in its lowermost position, the swivel is rigidly supported by the pedestals with each upper surface in contact with the respective one of the two support surfaces, said pedestals having a collapse strength chosen such that the pedestals collapse in a controlled, progressive manner in a series of folds, substantially without damage to the guide means, in the event the swivel and the string fall from at least a predetermined height, thereby protecting both the platform and the string from excessive loads associated with abrupt deceleration of the string support means and at least substantially reducing the incidence of string breakage due to such abrupt deceleration of the swivel.

7. In a drilling apparatus comprising a platform, means for supporting a string of down-hole tubulars, means for guiding the vertical movement of the string support means, and means for raising and lowering the string support means in the guide means, the improvement comprising:

at least two support surfaces, each positioned laterally with respect to the string and defined by the string support means; and at least two collapsible pedestals mounted on the platform, each comprising: a tubular member having a lower end positioned on the platform and an upper end; and a planar, substantially horizontal plate mounted to the upper end of the tubular member in alignment with the respective support surface; each pedestal positioned in alignment with a respective support surface such that the support surfaces come into contact with the pedestals when the string support means is lowered toward the platform, such that the pedestals rigidly support the string support means at a first level above the platform when static and in the event the string support means and the string fall from at least a predetermined height, shock dampening action takes place independently of the drill string and between the pedestals and the support surfaces positioned laterally to the drill string, thereby protecting the string from direct impact with the platform and the pedestals and from excessive loads associated with abrupt deceleration of the string support means and at least substantially reducing the incidence of string breakage due to such abrupt deceleration of the string support means.

* * * * *